United States Patent [19]

Mandel

[11] 4,060,918

[45] Dec. 6, 1977

[54] LONGITUDINALLY EXPANDABLE SHOE

[76] Inventor: Albert Mandel, 3668 Courtney Lane, Bethpage, N.Y. 11714

[21] Appl. No.: 721,388

[22] Filed: Sept. 8, 1976

[51] Int. Cl.[2] ..... A43B 3/26
[52] U.S. Cl. ..... 36/97
[58] Field of Search ..... 36/97, 91, 76 R, 81

[56] References Cited

U.S. PATENT DOCUMENTS

| | | | |
|---|---|---|---|
| 797,966 | 8/1905 | Lange et al. | 36/97 |
| 3,389,481 | 6/1968 | England | 36/97 |
| 3,922,800 | 12/1975 | Miller et al. | 36/97 |

FOREIGN PATENT DOCUMENTS

| | | | |
|---|---|---|---|
| 174,665 | 8/1905 | Germany | 36/97 |

*Primary Examiner*—Patrick D. Lawson

[57] ABSTRACT

A longitudinally expandable shoe includes a heel assembly which may be joined to a sole assembly; the heel and sole assemblies have sets of flexible platelike portions, respectively, which interleave with one another. Joining means fasten the heel and sole assemblies at a selectable spacing to one another, and height adjustable arch support means are joined with one end thereof to one of the heel and sole assemblies for supporting the foot of a wearer. An upper has front and rear portions attached to the sole and heel assemblies, respectively, and elastic joining means are provided for joining the upper front and rear portions.

2 Claims, 3 Drawing Figures

LONGITUDINALLY EXPANDABLE SHOE

BACKGROUND OF THE INVENTION

1. Field of the Invention

The field of the present invention relates to a longitudinally expandable shoe.

2. Description of the Prior Art

A plurality of expandable or adjustable shoes are known, the earliest such known shoe dating back to 1935. Thus there is known an adjustable shoe, whereby the length sides of the shoe may be easily varied, shoe construction wherein the shoe is formed of two main sections which are adapted to be joined together in a specially formed means for adjustment for the proper size before the shoe has been completely assembled, an adjusable shoe concerned primarily with shoes adapted for use by manikins, an expandable shoe for use by children from infant ages to teen-age, a footwear construction incorporating width wise adjustability in at least a part of the shoe in order for one shoe to be fitted for feet of different widths, and a transversely adjustable boot.

SUMMARY OF THE INVENTION

None of the aforesaid shoe constructions have made provisions, however, for an adjustable arch support; since it is well known that the comfort of a wearer depends largely not only on the proper length and width of a shoe, but also on a properly sized arch support, it is therefore an object of my present invention to provide an expandable shoe which also makes provision for an adjustable arch support.

I therefore provide a longitudinally expandable shoe which includes a heel assembly which may be joined to a sole assembly; the heel and sole assemblies have sets of flexible platelike portions, respectivey, which interleave with one another. Joining means fasten the heel and sole assemblies at a selectable spacing to one another, and height adjustable arch support means are joined with one end thereof to one of the heel an sole assemblies for supporting the foot of a wearer. An upper has front an rear portions attached to the sole and heel assemblies, respectively, and the upper rear portion has a counter; elastic joining means are provided for joining the upper front and rear portions. The upper front portion preferably includes a lace assembly. At least one of the sets of heels and sole assembly flexible platelike portions is formed with a plurality of co-extensive longitudinal slots, and the other of the sets is formed with a plurality of holes aligned substantially at right angles to the plate portion planes. The joining means includes fastener means which may be passed through the slots and the holes. Each of the sets of flexible platelike portions include outwardly facing first and second portions, and first and second metal plates may be joined to the first and second platelike portions, respectively; at least one of the first and second metal plates is formed with a longitudinal slit, and the other of the first and second metal plates is formed with a threaded opening. A threaded bolt may be screwed into the opening, and may be passed through the slit; the arch support means has a portion facing away from the foot and formed with a recess for receiving the bolt. One end of the bolt is freely rotatable in that recess, and a nut may be screwed on to the other bolt end so that the arch support means is movable in directions toward and away from the other of the metal plates in dependence of the direction of rotation of the bolt, the nut serving to hold the bolt in a selected position. A leaf spring, or the like, may be attached to the other of the heel and sole assemblies for clamping the other end of the arch support means thereto, and the joining means includes a rubber band or the like.

BRIEF DESCRIPTION OF THE DRAWING

My invention will be better understood with reference to the accompanying drawing in which.

DESCRIPTION OF THE PREFERRED EMBODIMENT

Figure 1:
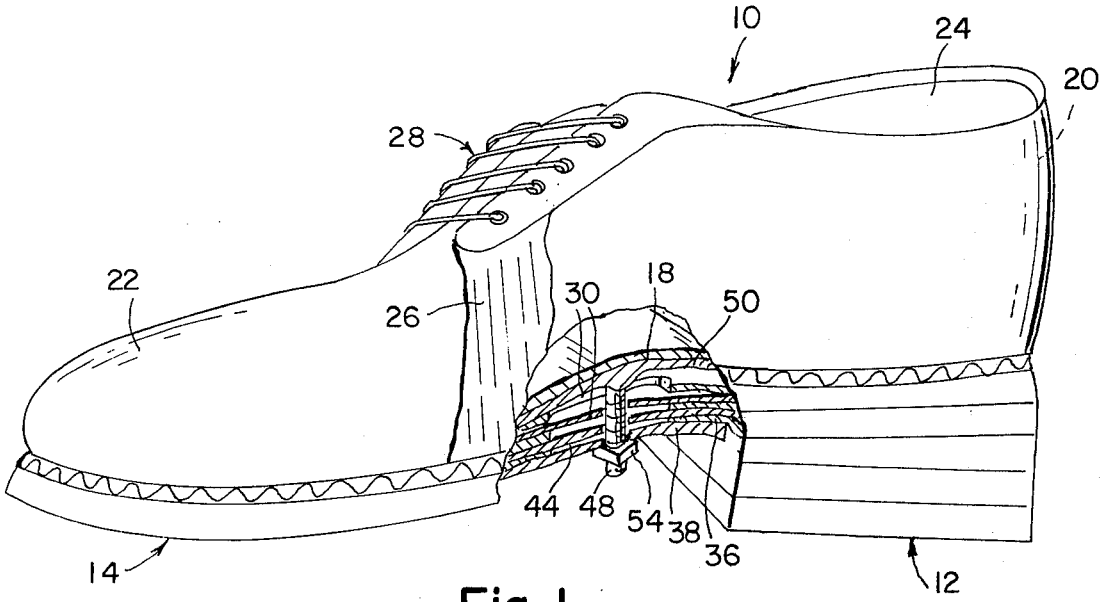
FIG. 1 shows a perspective view of the longitudinally expandable shoe, according to my invention.
Figure 2:
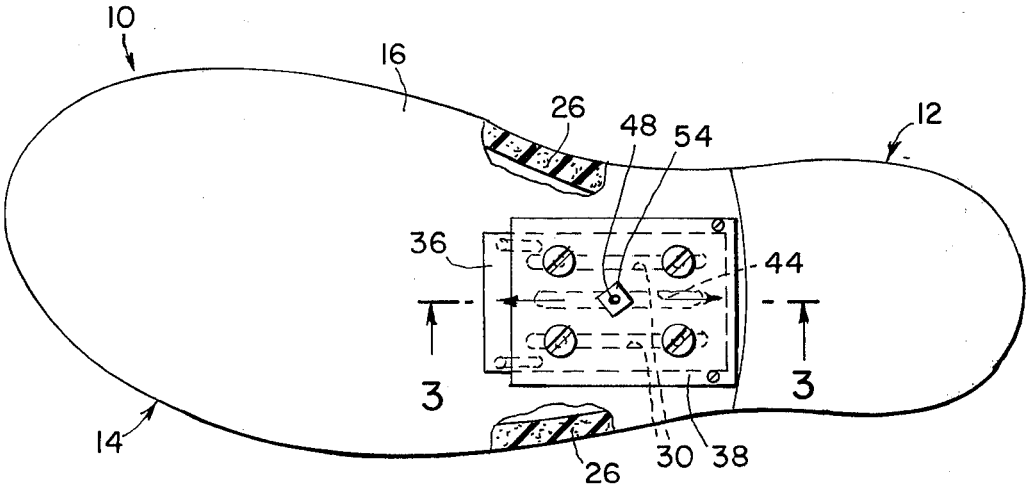
FIG. 2 is a bottom plan view of the shoe of FIG. 1.
Figure 3:
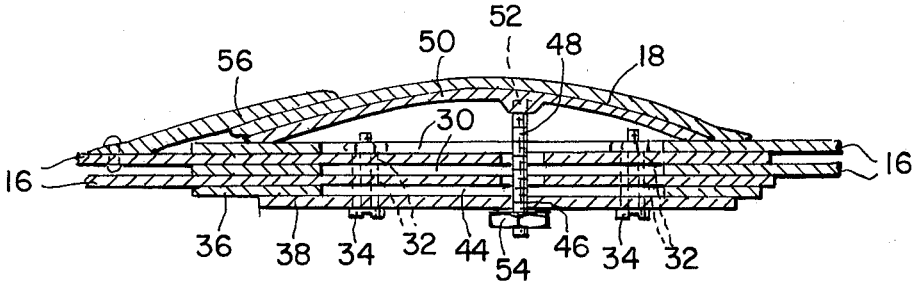
FIG. 3 is a section along the line 3—3 of FIG. 2.

Referring now to the drawing, a longitudinally expandable shoe 10 includes a heel assembly 12 joined to a longitudinal sole assembly 14; the heel and sole assemblies have sets of flexible platelike portions 16 which may, for example, consist of hard leather, respectively, and which may be interleaved with one another. Joining means are provided for fastening the heel and sole assemblies at a selectable spacing to one another, and height adjutable arch support means 18 may be joined with one end thereof to one of the heel and sole assemblies 12 or 14 for supporting the foot of a wearer. An upper has a front portion 22, and a ear portion 24 which may be attached to the sole and heel assemblies 14 and 12, respectively, and the upper rear portion 24 has a counter 20. Elastic joining means 26, for example in the form of a rubber band, are provided for joining the upper front portion 22 to the upper rear portion 24. The upper front portion 22 preferably includes a lace assembly 28. At least one of the sets of heel and sole assembly flexible platelike portions 16 is formed with a plurality of co-extensive longitudinal slots 30, and the other of the sets is formed with a plurality of holes 32 aligned substantially at right angles to the plate portion planes. The joining means includes a fastener means 34 which may be passed through the slots 30 and the holes 32. Each of the sets of flexible platelike portions 16 include outwardly facing first and second portions, and a first metal plate 36, and a second metal plate 38 may be joined to the first and second platelike portions 16, respectively; at least one of the metal plates 36 and 38 is formed with a longitudinal slit 44, and the other of the metal plates 36 and 38 is formed with a threaded opening 46; a threaded bolt 48 may be screwed into the opening 46 and passed through the slit 44. The arch support means 18 has a portion 50 facing away from the foot, and is formed with a recess 52 for receiving the bolt 48; one end of the bolt 48 is freely rotatable in the recess 52, and a nut 54 can be screwed onto the other bolt end, so that the arch support means 18 is movable in directions towards and away from the other of the metal plates 36 and 38 in dependence of the direction of rotation of the bolt 48, the nut 54 serving to hold the bolt 48 is a selected position. A leaf spring 56 or the like is attached to the other of the heel and sole assemblies 12 or 14 for clamping the other end of the arch support means 18 thereto.

The foregoing is considered as illustrative only of the principles of the present invention; since numerous modifications and changes will readily occur to those skilled in the art, it is not intended to limit the invention to the exact construction and operation shown and descried, the appended claims encompassing any suitable modifications and equivalents of the present invention. Accordingly, without further analysis, what is claimed is:

1. A longitudinally expandable shoe comprising:

a heel assembly joined to a longitudinal sole assembly, said heel and sole assembly each having a set of flexible platelike portions respectively interleaving with one another, one set of said flexible plate-like portions having a plurality of coextensive longitudinal slots, the other set having a plurality of holes aligned substantially at right angles to the plate portion planes, each of said sets of flexible plate-like portions including outwardly facing first and second portions, and further comprising first and second metal plates joined to said first and second plate-like portions respectively, at least one of said first and second metal plates being formed with a longitudinal slit, the other of said first and second metal plates being formed with a threaded opening, a threaded bolt screwed into said opening passing through said slit, said arch support means having a portion facing away from the foot and being formed with a recess for receiving said bold, one end of said bolt being freely rotatable in said recess, and a nut screwed onto the other bolt end, whereby said arch support means is movable in directions toward and away from the other of said metal plates in dependence of the direction of ratation of said bolt, said nut serving to hold said bolt in a selected position;

height adjustable arch support means joined with one end thereof to one end of said heel and sole assemblies for supporting the foot of a wearer;

an upper having front and rear portions attached to said sole and heel assemblies respectively;

elastic means joining the upper front and rear portions.

2. A longitudinally expandable shoe according to claim 1 further comprising a leaf spring or the like attached to the other of said heel and sole assemblies for clampting the other end of said arch support means thereto.

* * * * *